US006124033A

United States Patent [19]

Ha et al.

[11] Patent Number: 6,124,033

[45] Date of Patent: Sep. 26, 2000

[54] POLY(VINYL ALCOHOL) MICROFIBRILLAR SHORT FIBER AND METHOD FOR ITS USE

[75] Inventors: Wan Shik Ha, 88-30, Chungdam-dong, Kangnam-ku, Seoul, 135-100; Won Seok Lyoo, Seoul; Young Keun Choi, Kyungki-do, all of Rep. of Korea

[73] Assignees: Sunkyong Industries, Co., Ltd., Kyungki-do; Wan Shik Ha; Wan Seok Lyoo, both of Seoul, all of Rep. of Korea

[21] Appl. No.: 08/759,933

[22] Filed: Dec. 4, 1996

Related U.S. Application Data

[63] Continuation of application No. 08/449,654, May 24, 1995, abandoned.

[30] Foreign Application Priority Data

May 24, 1994 [KR] Rep. of Korea ..... 94-11368

[51] Int. Cl.[7] ..... D02G 3/00

[52] U.S. Cl. ..... 428/359; 428/364

[58] Field of Search ..... 428/359, 364; 162/145

[56] References Cited

U.S. PATENT DOCUMENTS

| | | | |
|---|---|---|---|
| 4,463,138 | 7/1984 | Wu et al. | 526/319 |
| 4,511,623 | 4/1985 | Yoon et al. | 428/359 |
| 4,885,058 | 12/1989 | Hani et al. | 162/145 |
| 5,238,995 | 8/1993 | Fukunishi et al. | 525/60 |

FOREIGN PATENT DOCUMENTS

| | | |
|---|---|---|
| 4-108109 | 4/1992 | Japan . |
| 4-117408 | 4/1992 | Japan . |
| 5-80215 | 4/1993 | Japan . |

OTHER PUBLICATIONS

Yamamoto et al. "Synthesis of High–Molecular Weight Poly(vinyl alcohol) of Various Tactic Contents through Photo–Emulsion Copolymerization of Vinyl Acetate and Vinyl Pivalate" Poly. Journal, V. 24, No. 1, pp. 115–119, 1992.

Yamamoto et al. Saponification of High Molecular Weight Poly(vinyl pivalate), Polymer Journal, vol. 23, No. 3, pp. 185–188, 1991.

*Primary Examiner*—Newton Edwards

*Attorney, Agent, or Firm*—Finnegan, Henderson, Farabow, Garrett & Dunner, L.L.P.

[57] ABSTRACT

This invention is a poly(vinyl alcohol) microfibrillar short fiber and its method of preparation, especially manufacturing a microfibrillar poly(vinyl alcohol) short fiber having high tensile strength, high tensile modulus, high fineness, and excellent alkali resistance using a special saponifying agent and through an advanced mechanical shearing operation in the course of saponification of poly(vinyl pivalate) to poly(vinyl alcohol) without requiring spinning, drawing, and heat treatment.

1 Claim, 4 Drawing Sheets

POLY(VINYL ALCOHOL) MICROFIBRILLAR SHORT FIBER AND METHOD FOR ITS USE

This application is a continuation, of application Ser. No. 08/449,654, filed May 24, 1995, now abandoned.

FIELD OF THE INVENTION

This invention relates to poly(vinyl alcohol) microfibrillar short fibers, especially a microfibrillar poly(vinyl alcohol) short fiber having high tensile strength, high tensile modolus, high fineness, and excellent alkali resistance. The short fiber is prepared by a method using alkali resistance. The short fiber is prepared by a method using a special saponifying agent and an advanced mechanical shearing operation in the course of saponification of poly(vinyl pivalate) to poly(vinyl alcohol) without the spinning, drawing, and heat treatment required for conventional high strength and high modulus poly(vinyl alcohol).

BACKGROUND OF THE INVENTION

Poly(vinyl alcohol) (hereinafter PVA) fiber has been spotlighted as textile and industrial fibers for more than sixty years since it was first prepared by Herrmann in 1931 [German Patent No. 685,048].

There are two types of PVA used as a raw material of PVA fiber having high tensile strength and high tensile modulus. The first type is a tactic PVA, with the following formula (a), and the other is syndiotactic PVA, represented by the following formula (b).

Since the syndiotactic PVA has structural stability due to zigzag-type molecular structure, the syndiotactic PVA fiber has better mechanical property, thermal stability, chemical and weather resistance, when compared to the atactic PVA fiber.

polymer had been solution-spun or gel-spun, the molecular chain of the PVA filament is oriented in parallel by the additional drawings and heat treatment. The PVA short fiber(staple) is prepared by cutting the continuous PVA filament to a suitable length. The high strength Vinylon® Fiber (Kuraray Co., Japan), now commercially available, is prepared by this method.

The conventional PVA fiber may also be prepared according to Japanese Patent Laid Open Document 04-108109. A monomer having a side group giving steric hindrance is polymerized and a syndiotacticity-rich precursor is synthesized by the saponification of the polymer, followed by separating, washing, and drying. It is redissolved in the solvent, spun, drawn and dried. The PVA filament prepared by this process is cut by a special cutting-machine to obtain the short staple fiber.

According to U.S. Pat. No. 4,511,623, a short fiber can be prepared by polymerization with the help of the special action of pyridine/amide solvent, without spinning and drawing processes, in the course of preparing rigid rod poly(p-phenylene terephthalamide) known as aamid. However, this patent does not show preparing the short fiber accumulated with ultrafine microfibrils from the flexible chain polymer PVA in the course of saponification.

According to U.S. Pat. No. 5,238,995, a PVA polymer is prepared by the saponification of poly(vinyl pivalate) dissolved in tetrahydrofuran with the saponifying agent composed of a potassium hydroxide/methanol solution, and then the PVA is separated, dried and redissolved in the solvent. After spinning, drawing, heat-treatment, washing, drying, and cutting, the PVA short fiber is produced. PVA prepared by this method has a degree of saponification of 99 mol %, syndiotactic and content of over 60%, a high degree of orientation, and high crystallinity.

According to Japanese Patent Laid Open Document 04-117408 and 05-080215, and Yamamoto [T. Yamamoto et al., Polymer Journal, 23,185(1991)], poly(vinyl acetate) can be completely saponified by a general saponification method using sodium hydroxide/methanol solution. However, this syndiotacticity-rich high molecular weight polymer containing high molecular weight poly(vinyl pivalate) cannot be saponified effectively using sodium hydroxide. Hence, Yamamoto dissolved the syndiotacticity-rich poly(vinyl pivalate) polymer in tetrahydrofuran and synthesized the PVA with a hydroxyl group content of over 99 mol % by saponifying using potassium hydroxide/methanol solution. This saponification method has the advantage that the degree of saponification of over 99 mol % can be obtained without molecular chain scission. However, the syndiotactic PVA, which has a strong intermolecular hydrogen bonding as formula(c) indicates, is synthesized quickly, forming many hydroxyl groups in a very short time by a vigorous and (a)

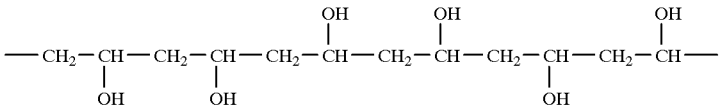

(b)

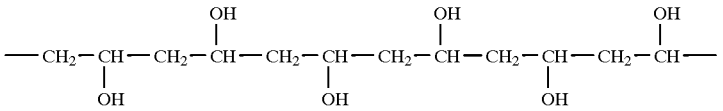

In general, in the conventional preparative method of PVA fiber, the spinning, drawing, and heat treatment processes are included to give high orientation to the molecular chain. But the syndiotactic PVA has difficulty in drawing, due to strong intermolecular hydrogen bonding caused by the molecular structure, when compared to the a tactic PVA.

It is known that the syndiotactic PVA fiber developed up to now has higher tensile strength and modulus at a lower draw ratio than the a tactic PVA fiber of the same molecular weight. Therefore, if the molecular orientation of the syndiotactic PVA having a compact structure is increased by increasing the draw ratio, the PVA fiber having higher tensile strength and modulus can be produced.

To prepare a conventional PVA short fiber poly(vinyl ester), the precursor of PVA is synthesized and this precursor is saponified to produce PVA. After the synthesized PVA speedy reaction of poly(vinyl pivalate) with the saponifying agent.

(c)

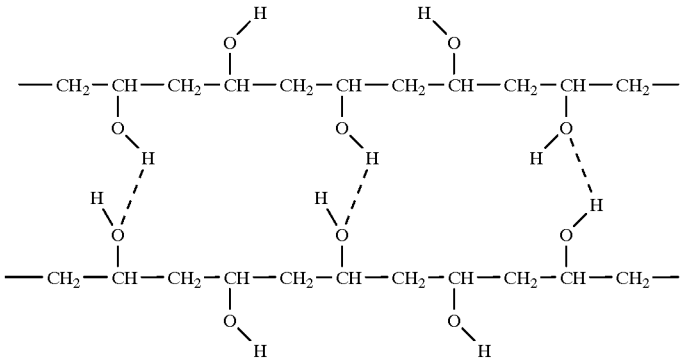

The hydrogen bonding force of the syndiotactic PVA causes gel or precipitate formulation after the completion of saponification.

Adding iodine compound to the PVA film prepared by film casting to improve the drawability of PVA has been developed [Y. S. Choi, et al., Polymer Journal, 22 601 (1990)]. This added iodine compound plays a role in weakening the intermolecular hydrogen bonding by changing the crystal structure of PVA, thus improving the drawability of the polymer. As this compound is removed after the drawing, the original crystal structure of PVA is recovered and a highly oriented material is obtained. However, such a method should be applied in the course of or after spinning or film casting.

The present inventors have conducted long term investigations and studies to develop a new method which can produce a PVA microfibrillar short fiber having high tensile strength and modulus, omitting procedures such as dissolving PVA synthesized after saponification, spinning the above PVA in the form of solution or gel, drawing more than ten times, and heating at a high temperature.

The present inventors have realized that the high strength and high modulus PVA microfibrillar fiber which has different length, diameter, and elongation can be produced by adding a special alkali saponifying agent to the syndiotacticity-rich high molecular weight poly(vinyl pivalate)/tetrahydrofuran solution while being stirred with a special shearing device at a certain shear rate.

The object of this invention is to simplify the complex preparation process of PVA fiber and to provide a PVA microfibrillar fiber having high tensile strength and modulus, excellent alkali resistance, and good thermal stability.

SUMMARY OF THE INVENTION:

This invention relates to the PVA microfibrillar short fiber which has a number-average degree of polymerization of 4,000–20,000, a syndiotactic diad content of 55–65%, the degree of saponification of 85.0–99.9%, a diameter of 1–50 micrometers, length of 0.5–300 mm, irregular cross-sections, needle point-like ends, and an accumulated ultrafine microfibrillar structure.

This invention prepares a PVA fiber only via saponification and mechanical stirring with a shear speed of over 500 rpm, while omitting later processes such as spinning, drawing and heating-treating, which are required for manufacturing conventional high strength and high modulus PVA fibers.

BRIEF DESCRIPTION OF THE DRAWINGS

FIG. 1(*a*) is a photomicrograph for microfibrillar fiber magnified 4,000 times.

FIG. 1(*b*) is a photomicrograph for microfibrillar fiber magnified 30,000 times.

FIG. 1(*c*) is a photomicrograph for microfibrillar fiber magnified 50,000 times.

DETAILED DESCRIPTION OF THE INVENTION

Figure 1A:
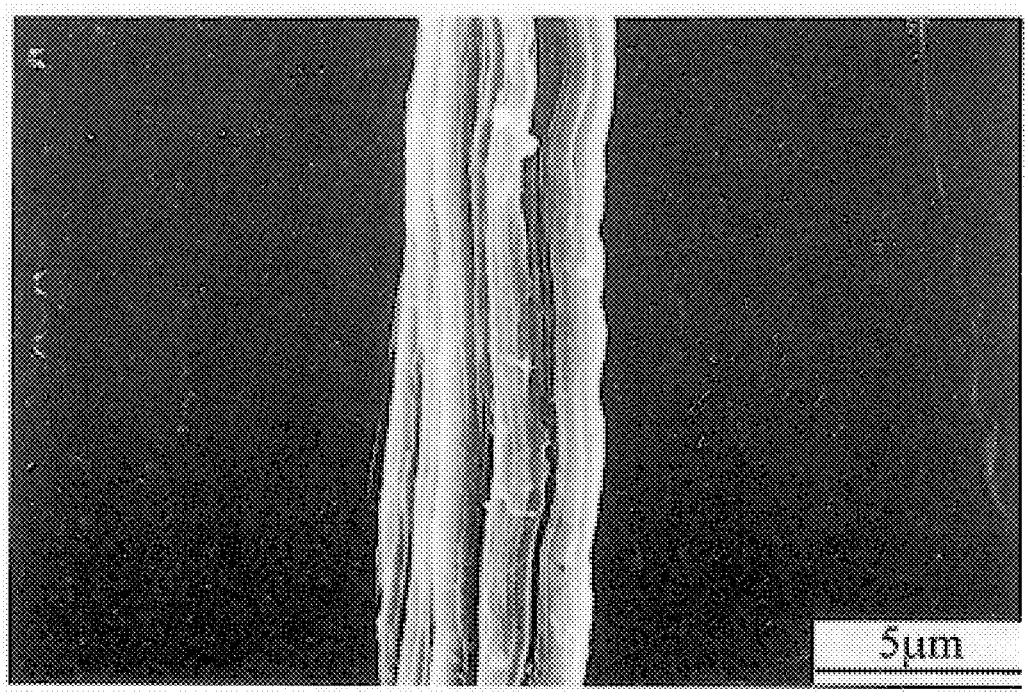
FIG. 1 shows scanning electron micrographs for poly (vinyl alcohol) microfibrillar fibers of this invention.

This invention prepares high strength and high modulus PVA microfibrillar short fiber directly by dissolving syndiotacticity-rich high molecular weight poly(vinyl pivalate) in an organic solvent and adding a saponification agent while being stirred with an advanced mechanical stirrer.

To prepare the PVA microfibrillar fiber having high tensile strength and modulus, excellent alkali resistance, high fineness, and good thermal resistance according to this invention, a high content of syndiotactic group, high molecular weight, degree of saponification of over 85%, good linearity of molecular chain, and absence of accompanying structure like 1,2-glycol, etc. should be kept. The most important factor which affects direct fiber formation during saponification and the physical properties of the PVA fiber is the syndiotacticity.

For instance, the PVA fiber having a high molecular weight, but a syndiotactic diad content of 4–5% lower than other PVA fibers having a small molecular weight, showed rather inferior mechanical and physical properties.

PVA, which has a number-average molecular weight of about 400,000 and syndiotactic diad content of about 50%, could not form fibril, but gel.

In the process of preparing the PVA fiber of this invention, the time needed for completing fibrillation is only about 15 minutes due to the use of a new saponification agent which has not only a hydrogen bond forming ability, but also acts as a solvent.

In the conventional method, after saponification had been completed, the produced PVA should be spun, drawn, and heat treated, whereas in this invention, the PVA microfibrillar fiber having high molecular orientation could be prepared successfully by the chemical reaction of the saponification agent. In addition, in this invention it is important to control the shear speed under appropriate conditions to prepare the microfibrillar short fiber.

The saponification agent has a main role in this invention. Poly(vinyl pivalate) is first converted into the syndiotactic PVA by saponification using a special saponification agent, and the definite amount of hydroxyl groups formed during saponification are bound with the saponifying agent to develop the molecular orientation of PVA in the fiber-axis direction. Then, after completing fibrillation, the saponification agent is separated from the microfibrillar fiber and the crystalline structure of PVA is formed.

The saponification agent in this invention has a hydrogen bond forming ability with PVA and plays a role in providing high orientation to the PVA structure by mechanical shearing action, maintaining intramolecular hydrogen bonding, and forming a bridge between the intermolecular hydrogen bonding of PVA.

A more detailed explanation for preparing the PVA microfibrillar short fiber with a high syndiotacticity in this invention follows. First, poly(vinyl pivalate) is dissolved in an organic solvent and oxygen in the reaction solution is removed while being stirred. After raising the reaction temperature to 50–60° C., and an alkaline saponifying agent is mildly added, it is stirred at 10,000 rpm. Thus, the viscosity of the reaction solution increases steeply in 6 minutes, and a gel is formed in the solution.

The reason for the gel formation is that pivaloyl groups, the side group of poly(vinyl pivalate), are cleaved by the reaction with an alkali in the saponification agent and transformed into hydroxyl groups, the side group of PVA. Many hydroxyl groups of the resultant PVA form not only intermolecular hydrogen bonding, but also intramolecular hydrogen bonding, and PVA is solidified without orientation to a specific direction.

However, as the stirring with 3,000 rpm or more is continued, water in the saponification agent is regularly arranged among the molecular chains of PVA, laying bridges between the PVA molecules. Accordingly, the intramolecular hydrogen bonding is kept, while the direct intermolecular hydrogen bonding between PVA molecules is intercepted, keeping constant the distance between PVA chains. In time, the whole reaction solution becomes a gel and well arranged molecular chains are kept as they are.

On the basis of the preparation described above, a solid-phase fibrous lump highly oriented to the fiber-axis direction is obtained.

According to the said manufacturing method in this invention, the concentration of water contained in the saponification agent is important. If water does not exist, the intermolecular hydrogen bonding between the PVA molecules cannot be enfeebled. If the amount of water is about $3\times10^{6}$ mole or more to 1 mole of poly(vinyl pivalate), logically the blocking of the intramolecular hydrogen bonding as well as the intermolecular hydrogen bonding of PVA is possible.

In order to arrange the molecular chain of PVA along a certain direction, regardless of the type of stirring device, vigorous stirring with the speed of over 100 rpm, preferably over 500 rpm, more preferably over 3,000 rpm or more, is necessary. For example, when the stirring speed was 500 rpm or less, the PVA fiber having high tensile strength and modulus could be formed, but the degree of orientation to the fiber-axis direction decreased.

The following formula (d) represents a syndiotactic PVA forming intermolecular hydrogen bridges between PVA and water.

(d)

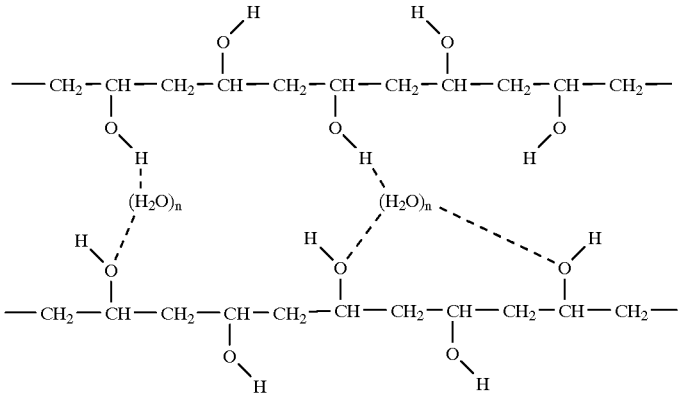

Using a mixture of potassium hydroxide/methanol/water as the saponification agent is a prerequisite for the preparation of the PVA microfibrilla short fiber in this invention. This solution consists of $1\times10^{-2}$–$7\times10^{-2}$ mole of potassium hydroxide, $5\times10^{-2}$–$5\times10^{-1}$ methanol, and $1\times10^{-3}$–$3\times10^{-1}$ mole of water to $1\times10^{-7}$–$7\times10^{-7}$ mole of poly(vinyl pivalate). tetrahydrofuran is especially the most effective solvent to form a strong fiber. Hence, it is possible to control the thickness and the length of the PVA microfibrillar fiber to any appreciable extent.

The fibers prepared using a modified H-shape anchor type stirrer were finer and longer than those prepared using a simple anchor type stirrer probably owing to the more regular propagation of shear force to the inner part of the reaction mixture. In the case of relatively higher shear rate, finer and longer fibrils were obtained by setting a housing to the stirrer in order to suppress the Weissenberg effect.

After saponification, the saponification reaction mixture obtained through a mechanical shearing operation is poured into methanol, followed by separation and washing.

To obtain a fibrillar fiber form, the solid fibrillar reaction mixture should be tapped mechanically or treated with an ultrasonic generator containing methanol solution.

The PVA fiber having needle point-like ends in this invention can be widely used for many purposes, since its properties are like natural cotton, ramie, linen or jute, and are exceptionally superior to those of natural fibers. Because of excellent adiabatic property which resulted from a very fine microfibrillar structure, the PVA microfibrillar fibers, 1–50 micrometers in diameter and 0.5–300 mm in length, can be used as a material replacing natural carcinogenic asbestos fiber. Furthermore, it is useful as a high performance composite material such as cement or concrete reinforcing fiber owning to the high tensile strength, high tensile modulus, excellent reinforcing fiber owing to the high tensile strength, high tensile modulus, excellent alkali resistance, and good affinity for the inorganic compound for building materials. The fiber in this invention can be used for a fishing net with the property of strong resistance to seawater and can be applied to the making of pulp for paper on the basis of its excellent physical properties.

The details of this invention are demonstrated by the following examples.

EXAMPLE 1

In a 500 ml 5-neck round bottom flask equipped with a thermometer, a nitrogen inlet, a reflux condenser, a dropping funnel, and an H-shape anchor-type stirrer, poly(vinyl pivalate) (1 g:$2.88\times10^{-7}$ mol) having a number-average degree of polymerization of 27,100 was dissolved in tetrahydrofuran (100 ml:1.23 mol).

After 10 ml of the mixed solution of potassium hydroxide (2.5 ml:$4.46\times10^{-2}$ mol), methanol (8.5 ml: $2.09\times10^{-1}$ mol), and water (1.5 ml:$8.31\times10^{-2}$ mol) had been added slowly to the above poly(vinyl pivalate) solution at 60° C. while being stirred at 500 rpm for 4 minutes, the stirring speed of the reaction solution was raised to 10,000 rpm for 5 minutes, and then reduced to 2,000 rpm for 10 minutes.

After the saponification reaction was complete, the solid fibrillar reaction mixture was tapped mechanically or treated in an ultrasonic generator containing methanol (300 ml). The fibers thus produced were filtered, washed several times with methanol, and dried in a vacuum.

EXAMPLE 2

In a 500 ml 5-neck round bottom flask equipped with a thermometer, a nitrogen inlet, a reflux condenser, a dropping funnel, and an H-shape anchor-type stirrer, poly(vinyl pivalate) (1 g:$2.39\times10^{-7}$ mol) having a number-average degree of polymerization of 32,600 was dissolved in tetrahydrofuran (100 ml 1.23 mol).

After 10 ml of the mixed solution of potassium hydroxide (2.5 ml:$4.46\times10^{-2}$ mol, methanol (8.5 ml: $2.09\times10^{-1}$ mol), and water (1.5 ml:$8.31\times10^{-2}$ mol) had been added slowly to the above poly(vinyl pivalate) solution at 60° C. while being stirred at 500 rpm for 4 minutes, the stirring speed of the reaction solution was raised to 10,000 rpm for 5 minutes, and then reduced to 2,000 rpm for 10 minutes.

After the saponification reaction was complete, the solid fibrillar reaction mixture was tapped mechanically or treated in an ultrasonic generator containing methanol (300 ml). The fibers thus produced were filtered, washed several times with methanol, and dried in a vacuum.

EXAMPLE 3

In a 500 ml 5-neck round bottom flask equipped with a thermometer, a nitrogen inlet, a reflux condenser, a dropping funnel, and an H-shape anchor-type stirrer, poly(vinyl pivalate) (1 g:$2.88\times10^{-7}$ mol) having a number-average degree of polymerization of 27,100 was dissolved in tetrahydrofuran (100 ml:1.23 mol).

After 10 ml of the mixed solution of potassium hydroxide (2.5 ml:$4.46\times10^{-2}$ mol), methanol (8.0 ml:$1.97\times10^{-1}$ mole), and water (2 ml:$1.16\times10^{-1}$ mol) had been added slowly to the above poly(vinyl pivalate) solution at 60° C. while being stirred at 500 rpm for 3 minutes, the stirring speed of the reaction solution was raised to 10,000 rpm for 5 minutes, and then reduced to 2,000 rpm for 10 minutes.

After the saponification reaction was complete, the solid fibrillar reaction mixture was tapped mechanically or treated in an ultrasonic generator containing methanol (300 ml). The fibers thus produced were filtered, washed several times with methanol, and dried in a vacuum.

EXAMPLE 4

In a 500 ml 5-neck round bottom flask equipped with a thermometer, a nitrogen inlet, a reflux condenser, a dropping funnel, and an H-shape anchor-type stirrer, poly(vinyl pivalate) (1 g:$2.88\times10^{-7}$ mol) having a number-average degree of polymerization of 27,100 was dissolved in tetrahydrofuran (100 ml:1.23 mol).

After 10 ml of the mixed solution of potassium hydroxide (2.5 ml:$4.46\times10^{-2}$ mol, methanol (8.5 ml:$2.09\times10^{-1}$ mole), and water (1.5 ml:$8.31\times10^{-2}$ mol) had been added slowly to the above poly(vinyl pivalate) solution at 55° C. while being stirred at 500 rpm for 4 minutes, the stirring speed of the reaction solution was raised to 10,000 rpm for 8 minutes, and then reduced to 2,000 rpm for 10 minutes.

After the saponification reaction was complete, the solid fibrillar reaction mixture was tapped mechanically or treated in an ultrasonic generator containing methanol (300 ml). The fibers thus produced were filtered, washed several times with methanol, and dried in a vacuum.

Comparative Example 1

In a 500 ml 5-neck round bottom flask equipped with a thermometer, a nitrogen inlet, a reflux condenser, a dropping funnel, and an H-shape anchor-type stirrer, poly(vinyl pivalate) (1 g:$1.47\times10^{-6}$ mol) having a number-average degree of polymerization of 7,900 was dissolved in tetrahydrofuran (100 ml:1.23 mol).

After 10 ml of the mixed solution of potassium hydroxide (2.5ml:$4.46\times10^{-2}$ mol), methanol (8.5 ml:$2.09\times10^{-1}$ mole), and water (1.5 ml:$8.31\times10^{-2}$ mol) had been added slowly to the above poly(vinyl pivalate) solution at 60° C. while being stirred at 500 rpm for 4 minutes, the stirring speed of the reaction solution was raised to 10,000 rpm for 5 minutes, and then reduced to 2,000 rpm for 10 minutes.

The reactant mixture became solidified without the formation of the microfibrillar fiber. After the solid reaction mixture had been washing in methanol (300 ml), gel and precipiatate-type (PVA)s were obtained.

Comparative Example 2

In a 500 ml 5-neck round bottom flask equipped with a thermometer, a nitrogen inlet, a reflux condenser, a dropping funnel, and an H-shape anchor-type stirrer, poly(vinyl pivalate) (1 g:$2.88\times10^{-7}$ mol) having a number-average degree of polymerization of 27,100 was dissolved in tetrahydrofuran (100 ml:1.23 mol).

After 10 ml of the mixed solution of potassium hydroxide (2.5ml:$4.46\times10^{-2}$ mol) and methanol (10 ml:$2.46\times10^{-4}$ mole), had been added slowly to the above poly(vinyl pivalate) solution at 60° C. while being stirred at 500 rpm for 4 minutes, the stirring speed of the reaction solution was raised to 10,000 rpm for 5 minutes, and then reduced to 2,000 rpm for 10 minutes.

The reactant mixture became solidified without fibril formation. After the reaction mixture solidified had been transferred to the other flask, the needle-like precipitate was obtained by mechanical crushing with a high speed mixer.

The characteristics of the PVA microfibrillar fiber prepared by the methods demonstrated in examples 1.4 are shown in the following table.

| | Example | | | | Comparative Example | |
|---|---|---|---|---|---|---|
| | 1 | 2 | 3 | 4 | 1 | 2 |
| Syndiotactic diad content (mol %) | 64 | 59 | 64 | 64 | 52 | 64 |
| Degree of saponification (mol %) | 99.4 | 99.6 | 99.0 | 96.1 | 99.7 | 99.1 |
| Crystal melting temperature | 260 | 247 | 258 | 253 | 231 | 248 |
| Tensile strength (g/den) | >15 | >9 | >12 | >10 | — | — |
| Number-average degree of polymerization | 16,700 | 15,400 | 16,800 | 17,200 | 5,400 | 16,100 |

In this invention, poly(vinyl pivalate), which has very good structural regularity is used as a starting material.

To prepare a PVA microfibrillar short fiber having high tensile strength and modulus in this invention, structural regularity and the degree of saponification of PVA are important. Adequate degree of saponification, i.e., appropriate concentration of hydroxyl groups, plays an important role in preparing the PVA fiber having high tensile strength and modulus since this makes the PVA molecular chains effectively oriented and the size of crystal formed properly controlled.

In this invention, the tensile strength was over 15 g/den for a degree of saponification of 99.4 mol %, and the crystal melting temperature of the PVA microfibrillar fiber prepared according to example 1 in this invention was over 260° C. by differential scanning calorimetry. The crystal melting temperature of the microfibrillar fiber in this invention is comparable to that of a fiber prepared by spinning PVA having a similar syndiotactic diad content and molecular weight in dimethylsulfoxide, drawing over 10 times, and heat-treating at over 200° C.

According to this invention, the PVA microfibrillar fiber, being a match for the high strength PVA spun fiber, can be prepared even though the conventional processes, spinning, high drawing, and heat-treating at a high temperature are ommitted.

The tensile strength of the PVA microfibrillar fiber prepared by the method given in example 1 in this invention surprisingly indicated over 15 g/den on an instron tensile tester. To prepare a fiber having the tensile strength of over 15 g/den by a conventional method, PVA with a very high molecular weight should be synthesized, and making a stable solution is very difficult owing to its high molecular weight. After the solution or gel had been made, the spinning, drawing over 10 times, and heat-treating at a high temperature must be conducted. However, in this invention, all the above processes are omitted and the high strength PVA fiber can be obtained only by the saponification of poly(vinyl pivalate). Moreover, the degree of solubility of the PVA microfibrillar fiber in this invention in hot water at 105° C. for 3 hours was nil and the degree of swelling in water at 30° C. for 50 hours was below 0.2. These values are lower than those of a PVA fiber prepared via the spinning, drawing and heat-treating in the conventional method.

It was known that these values cannot be obtained, if the additional acetalization procedure for the reduction of the degrees of solubility and swelling to boiling water does not proceed. Accordingly, the PVA microfibrillar fiber prepared by the method described in this invention has low degrees of solubility and swelling to boiling water despite the omission of the conventional spinning, drawing, heat-treatment, and acetalization.

The PVA fiber in this invention has a very high resistance to strong alkaline aqueous solutions of over pH 13.5.

Figure 1B:
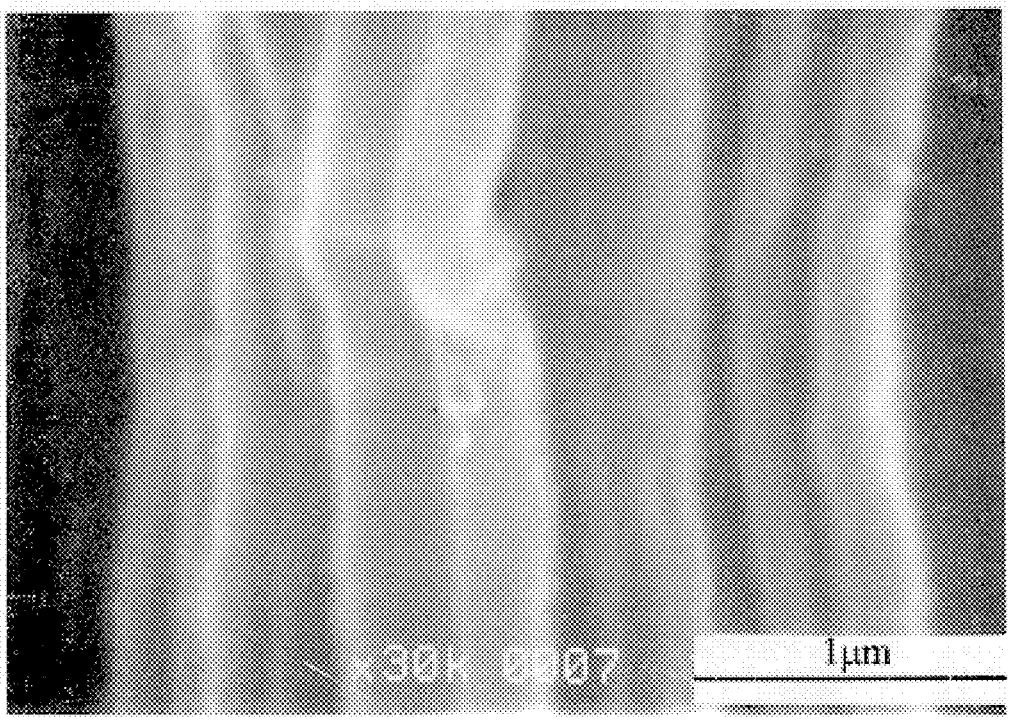
Figure 1C:
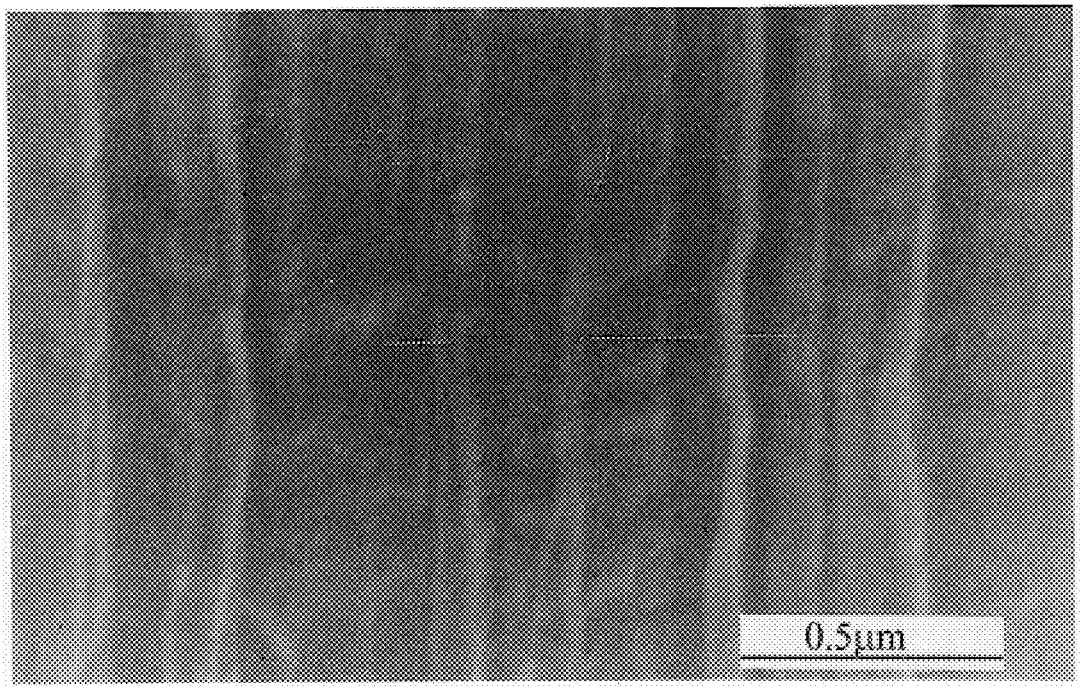
Figure 2:
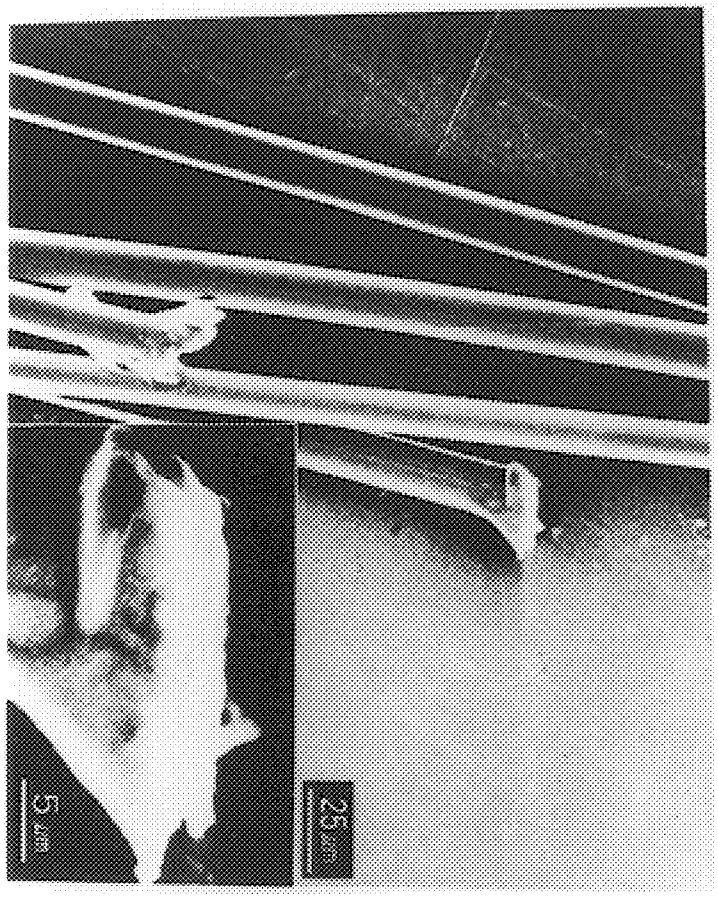
FIG. 2 shows a scanning electron micrograph for the commercial poly(vinyl alcohol) monofilament prepared via the conventional spinning method.

FIG. 1 shows the scanning electron micrographs for the PVA microfibrillar short fiber in this invention. It shows that the PVA microfibrillar short fiber has an accumulated ultrafine microfibril structure unlike the conventional PVA spun fiber and the fibrils are highly oriented.

Additionally, the degree of crystallinity of the fiber in this invention was determined using a density gradient tube and a value of more than 40% was obtained. This value cannot be obtained if the conventional PVA fiber is not heat-treated at over 150° C. and not drawn over several times. The apparent crystallite size obtained by the wide-angle X-ray diffraction analysis of the PVA fiber in this invention was over 45 Å.

What is claimed is:

1. A PVA microfibrillar short fiber comprising a dimension of 1 to 50 micrometers in diameter and 0.5 to 300 mm in length, a syndiotactic diad content of 55 to 64 mol. %, a degree of saponification of 85.0 to 99.9 mol. %, a number-average degree of polymerization of 4,000 to 20,000, needle point-like ends, and an accumulated ultrafine microfibril structure.

* * * * *